US008500958B2

(12) United States Patent
Jeffrey et al.

(10) Patent No.: US 8,500,958 B2
(45) Date of Patent: Aug. 6, 2013

(54) BELT AND METHOD TO MANUFACTURE

(75) Inventors: John Jeffrey, Blackburn Lancashire (GB); Michael Spence, Blackburn (GB); Andrew Allum, Darwen Lancashire (GB); Paul Rydin, Blackburn Lancashire (GB)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 12/818,806

(22) Filed: Jun. 18, 2010

(65) Prior Publication Data

US 2012/0073776 A1 Mar. 29, 2012

Related U.S. Application Data

(63) Continuation of application No. PCT/EP2008/063365, filed on Oct. 7, 2008.

(30) Foreign Application Priority Data

Dec. 19, 2007 (DE) ..... 10 2007 055 864

(51) Int. Cl.
*D21F 2/00* (2006.01)
*D21F 7/08* (2006.01)
*D21F 3/02* (2006.01)

(52) U.S. Cl.
USPC ..... 162/306; 162/358.2; 162/358.4; 162/901

(58) Field of Classification Search
USPC ..... 162/358.1, 358.2, 358.3, 358.4, 900–903, 162/306, 361, 362, 116; 442/79, 80, 83, 86, 442/89, 148
See application file for complete search history.

(56) References Cited

U.S. PATENT DOCUMENTS

| | | | | |
|---|---|---|---|---|
| 2,416,232 | A | 2/1947 | Soday | |
| 4,781,967 | A | 11/1988 | Legge et al. | |
| 5,302,251 | A | 4/1994 | Schiel et al. | |
| 6,027,615 | A | 2/2000 | Davenport et al. | |
| 6,231,928 | B1 * | 5/2001 | McGahern | 427/391 |

(Continued)

FOREIGN PATENT DOCUMENTS

| | | | |
|---|---|---|---|
| DE | 10 2007 019 960 | A1 | 11/2008 |
| DE | 10 2007 000 578 | A1 | 4/2009 |

(Continued)

OTHER PUBLICATIONS

International Search Report dated Jan. 26, 2009 of International Searching Authority for PCT/EP2008/063365 (6 pages).

(Continued)

*Primary Examiner* — Eric Hug
(74) *Attorney, Agent, or Firm* — Taylor IP, P.C.

(57) ABSTRACT

The invention relates to a transport or processing belt for a machine for the production or treatment of a fiber web, particularly a paper, cardboard or tissue machine, having a paper side and a conveying side and comprising a polymer coating and a textile load-bearing fabric, wherein the textile fabric has a first side facing the paper side and a second side facing the conveying side. The textile fabric is permeable with a permeability of at least 300 cfm, preferably of at least 500 cfm, and the polymer coating extends in one piece from the first side of the textile fabric though the openings of the textile fabric to the second side of the textile fabric.

27 Claims, 8 Drawing Sheets

U.S. PATENT DOCUMENTS

| | | | | |
|---|---|---|---|---|
| 6,648,147 | B1 | 11/2003 | Lydon et al. | |
| 7,090,747 | B2 * | 8/2006 | Watanabe et al. | 162/358.4 |
| 7,297,233 | B2 | 11/2007 | Herman et al. | |
| 7,351,307 | B2 | 4/2008 | Scherb et al. | |
| 7,413,633 | B2 * | 8/2008 | Li et al. | 162/358.4 |
| 7,670,461 | B2 | 3/2010 | Westerkamp | |
| 7,749,925 | B2 | 7/2010 | Morton | |
| 7,871,497 | B2 | 1/2011 | Westerkamp | |
| 7,871,672 | B2 | 1/2011 | Crook et al. | |
| 7,981,820 | B2 | 7/2011 | Westerkamp et al. | |
| 8,034,730 | B2 | 10/2011 | Westerkamp et al. | |
| 2002/0102894 | A1 * | 8/2002 | Hansen | 442/240 |
| 2004/0126601 | A1 | 7/2004 | Kramer et al. | |
| 2004/0237210 | A1 | 12/2004 | Thoroe-Scherb et al. | |
| 2005/0145360 | A1 | 7/2005 | Hikida | |
| 2005/0167062 | A1 | 8/2005 | Herman et al. | |
| 2006/0198996 | A1 | 9/2006 | Morton | |
| 2007/0003760 | A1 | 1/2007 | Crook et al. | |
| 2007/0026751 | A1 | 2/2007 | Westerkamp | |
| 2007/0111011 | A1 | 5/2007 | Westerkamp | |
| 2008/0010852 | A1 | 1/2008 | Oechsle et al. | |
| 2009/0199988 | A1 | 8/2009 | Westerkamp et al. | |
| 2011/0244132 | A1 | 10/2011 | Jeffery et al. | |

FOREIGN PATENT DOCUMENTS

| | | | |
|---|---|---|---|
| DE | 10 2007 055 687 | A1 | 6/2009 |
| DE | 10 2007 055 690 | A1 | 6/2009 |
| EP | 0 659 934 | A2 | 6/1995 |
| EP | 0659934 | | 6/1995 |
| EP | 1 081 275 | A2 | 3/2001 |
| EP | 1081275 | | 3/2001 |
| WO | 2008/131984 | A1 | 11/2008 |

OTHER PUBLICATIONS

English translation of International Preliminary Report on Patentability dated Jul. 20, 2010 of International Searching Authority for PCT/EP2008/063365 (6 pages).

English translation of Written Opinion (undated) of International Searching Authority for PCT/EP2008/063365 (5 pages).

* cited by examiner

BELT AND METHOD TO MANUFACTURE

CROSS REFERENCE TO RELATED APPLICATIONS

This is a continuation of PCT application No. PCT/EP2008/063365, entitled "TRANSPORT BELT AND METHOD FOR THE PRODUCTION THEREOF", filed Oct. 7, 2008, which is incorporated herein by reference.

BACKGROUND OF THE INVENTION

1. Field of the Invention

The invention relates to a belt for a machine for the production and treatment of a fibrous web, in particular a paper, cardboard or tissue machine, as well as to a method to manufacture said belt.

2. Description of the Related Art

Belts are used in machinery for the production and treatment of a fibrous web for example in the press section in order to transport the fibrous web through the press nip and subsequently to a transfer location where the fibrous web is transferred to the following dryer section.

Belts generally comprise at least one polymer coating providing the paper side of the belt into which a load-bearing textile fabric is embedded.

The known transport- or process belts often tend to delaminate during operation. The polymer coating which extends from the paper side to the machine side of the belt was applied from both sides of the textile fabric which therefore has an interior interface at which the polymer coatings separate during operation due to flexing.

In addition, the known transport- and process belts have several coating segments arranged adjacent to each other in cross machine direction, each of which represent only a partial width of the total polymer coating and which together form the polymer coating. The hitherto known transport- or process belts often break at the contact points of the coating segments.

In view of the aforementioned disadvantages, what is needed in the art is improved belts, as well as improved methods for their manufacture.

SUMMARY OF THE INVENTION

According to a first aspect of the invention, the present invention provides a transport- or process belt for a machine for the production or treatment of a fibrous web, especially a paper, cardboard or tissue machine, which has a paper side and a machine side, as well as a polymer coating and which includes a load-bearing textile fabric; whereby the textile fabric has a first side facing the paper side and a second side facing the machine side; whereby the textile fabric is permeable and has a permeability of at least 300 cfm, preferably of at least 550 cfm, and the polymer coating extends integrally from the first side of the textile fabric through the openings in the textile fabric to the second side of the textile fabric.

Based on the fact that the textile fabric has a permeability of at least 300 cfm, a polymer coating extending integrally from the first side of the textile fabric through the openings of the textile fabric to the second side of the textile fabric can be formed. Therefore, delamination of the polymer coating is almost impossible. Integrally in this context is to be understood that, viewed in thickness direction of the polymer coating, no interface exists inside the polymer coating extending from the first side to the second side of the textile fabric as could for example develop if the polymer material is applied onto the textile fabric from both sides and then meeting somewhere inside the textile fabric structure, thus forming an interface.

According to a second aspect of the invention, the present invention provides a method for the manufacture of a transport or process belt for a machine for the production or treatment of a fibrous web, in particular a paper, cardboard or tissue machine, with a textile fabric and a polymer coating comprising the following steps:

a) Providing a textile and permeable fabric which, viewed in the designated cross machine direction of the belt has a defined width as well as a first side facing the provided paper side of the belt and a second side facing the provided machine side of the belt;
b) Coating of the permeable textile fabric on a partial width with polymer material in a viscous state in order to provide a first formed coating segment;
c) Coating of the permeable textile fabric on a partial width with polymer material in a viscous state in order to provide a subsequently formed coating segment which overlaps the initially formed coating segment in certain areas in machine cross direction;
d) Causing a bond of the two coating segments in the overlap area;
e) Converting the polymer material from the viscous state to a solid state.

By providing an overlap area of adjacent coating segments, their bond with each other is clearly improved.

According to a third and alternative and/or additional aspect of the invention, the present invention provides a method for the manufacture of a transport or process belt for a machine for the production or treatment of a fibrous web, in particular a paper, cardboard or tissue machine, comprising the following steps:

a) Providing a permeable textile fabric with a first and a second longitudinal edge, respectively extending in the designated machine direction of the belt;
b) Coating of the textile fabric with polymer material in a viscous state by means of a coating apparatus, whereby only a partial width of the textile fabric is coated simultaneously with the viscous polymer material by means of the coating apparatus;
c) Converting the polymer material from the viscous to a solid state, whereby the textile fabric is a continuous belt and the continuous textile fabric is moved in the designated machine direction of the belt and the coating apparatus is moved in the designated cross machine direction of the belt relative to each other so that after movement of the coating apparatus from the first to the second longitudinal edge of the textile fabric the polymer material which was applied onto the textile fabric in a helix-type path forms a polymer coating which totally covers the textile fabric.

The helix-type application of the polymer material upon the textile fabric creates a polymer coating which progresses uninterrupted in machine direction.

According to a fourth alternative and/or additional aspect of the invention, the present invention provides a method for the manufacture of a transport or process belt for a machine for the production or treatment of a fibrous web, in particular a paper, cardboard or tissue machine, by coating a permeable textile fabric with polymer material in a viscous state, whereby a gap shaped forming channel is formed through which the textile fabric is led, whereby the forming channel has a front and a back limiting area each extending parallel to the textile fabric and between which the textile fabric is guided, whereby a first forming belt is provided which provides one of the two limiting areas and which is moved in the same direction as the textile fabric and essentially at the same speed while the viscous polymer material is fed into the forming channel and is carried along by the textile fabric and the first forming belt. Thereafter the first forming belt is separated from the polymer material at the end of the forming channel, whereby the first forming belt in the area of one of its longitudinal edges—on the side facing the textile fabric—has an elevation extending parallel to the longitudinal edge of the forming belt which provides a laterally limiting area of the forming channel.

By providing a lateral limiting area of the forming channel through the forming belt, the width of the overlapping region of the adjacent coating segments can be defined. This allows for a defined control and improvement for bonding between the coated segments.

According to a fifth alternative and/or additional aspect of the invention, the present invention provides a method for the manufacture of a transport- or process belt for a machine for the production or treatment of a fibrous web, in particular a paper, cardboard or tissue machine, by coating a permeable textile fabric with polymer material in a viscous state, whereby a gap shaped forming channel is formed through which the textile fabric is led, whereby the forming channel has a front and a back limiting area each extending parallel to the textile fabric and between which the textile fabric is guided along a transport direction, whereby means are provided through which the textile fabric is held during coating with the viscous polymer material so that it causes no waves or wrinkles.

The means ensure that the textile fabric is centered in the polymer coating. It is further ensured that the textile fabric is evenly embedded in the polymer coating, thereby clearly increasing the dimensional stability of the finished transport or process belt.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
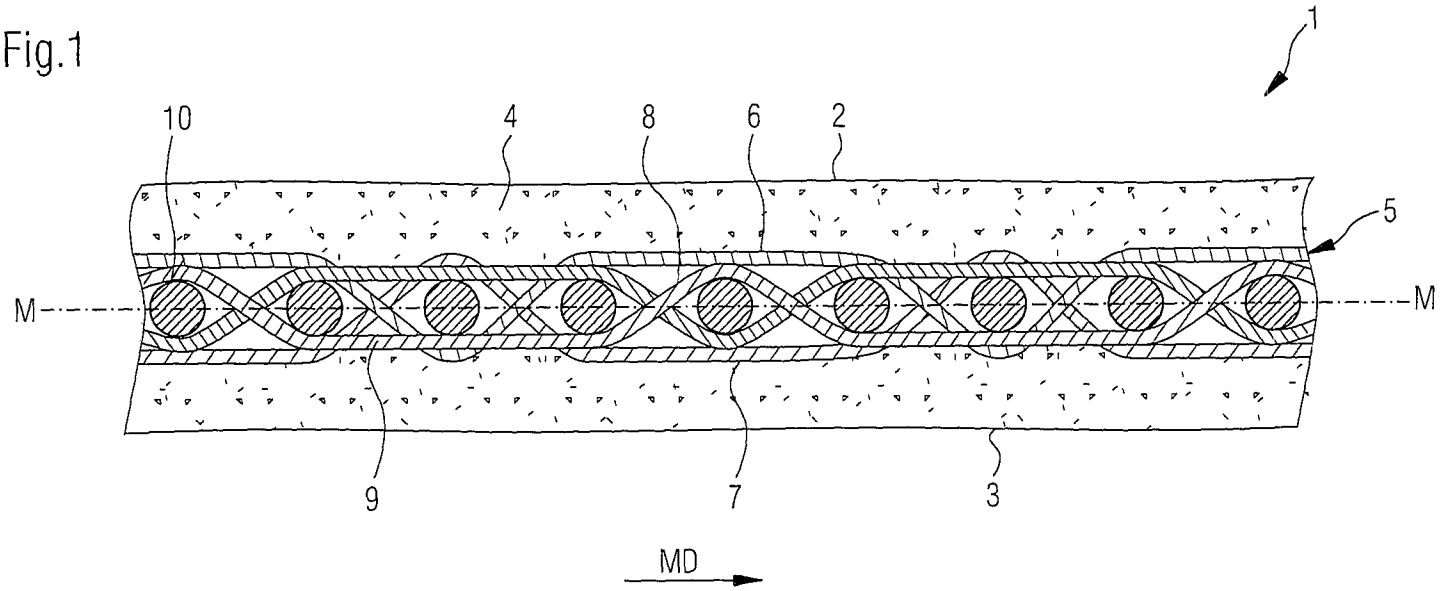
FIG. 1 shows a sectional view of an inventive transport or process belt along the machine direction of the belt.

Referring now to the drawings, and more particularly to FIG. 1, there is shown one design form of an inventive transport or process belt 1 in a sectional plane extending in machine direction (MD). Belt 1 has a paper side 2 and a machine side 3. Belt 1 further includes a polymer coating 4 and a textile load-bearing fabric structure 5. Textile fabric 5 has a first side 6 facing paper side 3 and a second side 7 facing machine side 3.

Textile fabric 5 is permeable and has a permeability of at least 300 cfm, preferably at least 550 cfm. Polymer coating 4 extends integrally from the first side 6 of textile fabric 5 through openings 8 in textile fabric 5 to the second side 7 of the textile fabric 5.

Hereby the polymer coating 4 is preferably produced—at least from the first side 6 to the second side 7 of textile fabric 5—from a single polymer material. This embodiment provides a belt which has practically no tendency to delaminate.

In the current example polymer coating 4 extends in a single piece from paper side 2 of belt 1 to machine side 3 of belt 1, and is produced preferably from a single polymer material from paper side 2 of belt 1 to machine side 3 of belt 1.

Belt 1 can have an overall thickness in the range of approx. 2 mm to approx. 6 mm, whereby preferably the ratio of overall thickness of belt 1 to the thickness of the textile fabric 5 is in the range of 2:1 to 5:1.

The total width of the belt can be in the range of approx. 1 m to approx. 12 m.

The polymer material of the polymer coating exemplarily includes polyurethane. Advantageously the polymer material consists completely of polyurethane. In addition one or several filler(s) may be embedded into polymer coating 4.

Textile fabric 5 has a center plane extending through the center of the thickness of textile fabric 5 which is indicated in the illustration in FIG. 1 by line M-M. Preferably the same amount of polymer material is applied on both sides of the center plane so that polymer coating 4 has a uniform thickness with respect to the center plane.

In addition, polymer coating 4 is preferably impermeable, so that consequently an impermeable belt 1 is provided.

Textile fabric 5 preferably has a permeability in the range of approx. 500 cfm to approx. 1200 cfm, preferably approx. 550 cfm to approx. 900 cfm.

Textile fabric 5 can be formed by itself or in combination with a woven fabric, a spiral wire or a yarn array. In the current example the textile fabric is provided by a woven fabric.

Textile fabric 5 comprises machine direction threads 9 and cross machine direction threads 10, whereby cross machine direction threads 10 have a greater flexural strength in their longitudinal direction than the machine direction threads 9 in their longitudinal direction. Textile fabric 5 which represents the load-bearing structure of the belt hereby gains a very high flexural strength in cross machine direction (CMD) and thereby a high dimensional stability. The higher flexural strength of cross machine direction threads 10 as opposed to the flexural strength of the machine direction threads can be achieved for example in that the machine direction threads 9 in their cross section have a greater width than height, whereas the cross machine threads 10 in their cross section have a width which is equal to the height. The different flexural strength may however also be influenced or completely determined by the selection of the material or materials from which machine direction threads 9 and cross machine direction threads 10 are manufactured.

In the current design example textile fabric 5 is in the embodiment of a woven fabric 5, meaning that machine direction threads 9 are interwoven with cross machine direction threads 10, whereby in order to form woven fabric 5 machine direction threads 9 are more curved in their longitudinal progression than the cross machine direction threads 10 in their longitudinal progression.

Cross machine direction threads 10 progress preferably not curved in their longitudinal direction.

Figure 2:
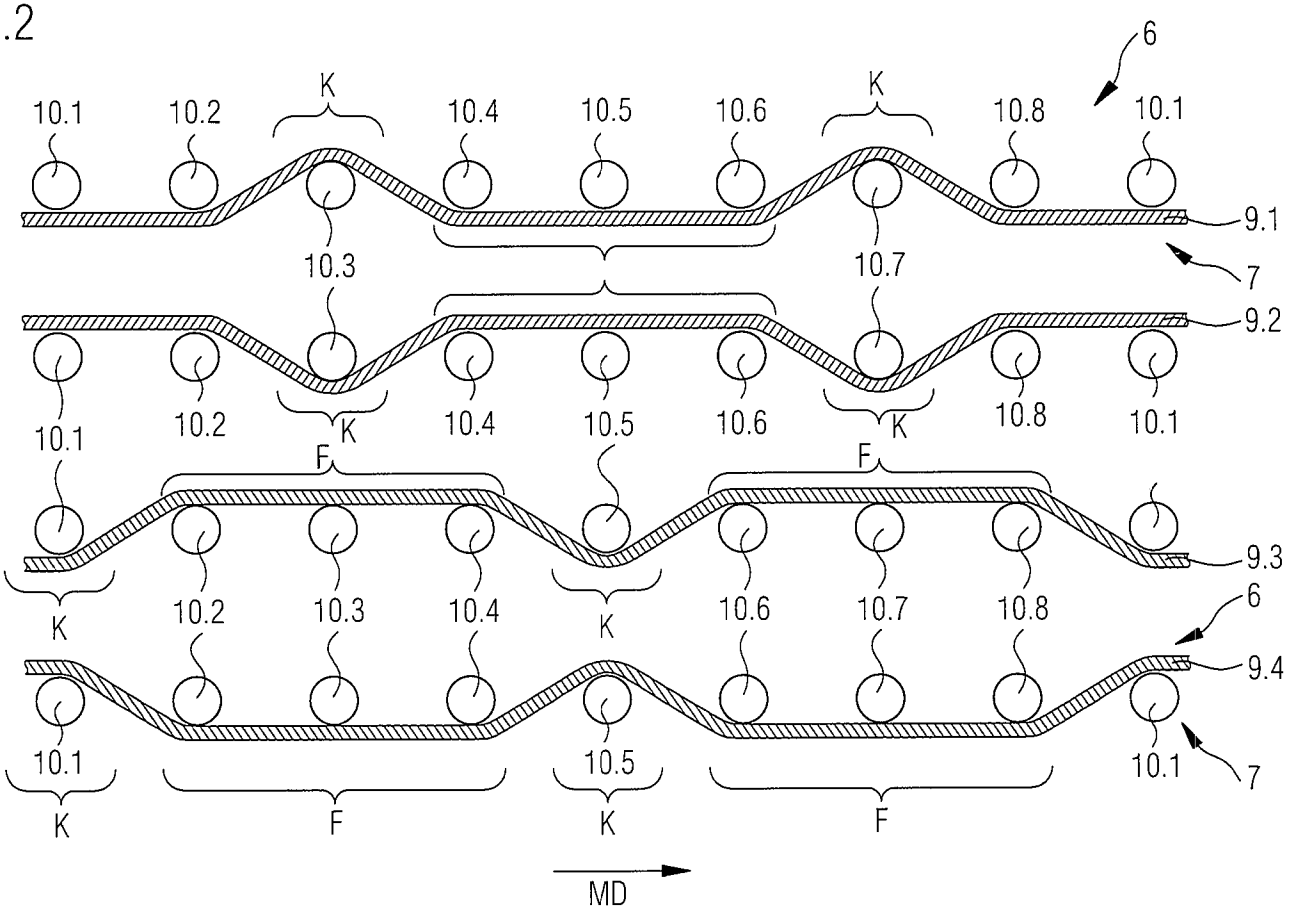
FIG. 2 shows a repeat of the textile fabric of the belt illustrated in FIG. 1.

According to a preferred embodiment of the invention, woven fabric 5 comprises a repeat weaving pattern. FIG. 2 illustrates such a repeat pattern. The repeat preferably includes machine direction threads of a first type 9.2, 9.3 which, on the first side 6 of textile fabric 5, cross a first number of successive cross machine threads 10.4-10.6, 10.8-10.2, 10.2-10.4, 10.6-10.8, creating a flotation F, before they continuously cross a single cross machine thread 10.3, 10.7, 10.1, 10.5 on the second side 7 of woven fabric 5 while creating a bend K.

For example the machine direction thread of the first type 9.2 floats on the first side 6 of woven fabric 5 continuously over the three successive cross machine direction threads 10.4-10.6 before it runs on the second side 7 of the woven fabric and forms a bend K over the cross machine direction thread 10.7.

In addition, the repeat includes preferably machine direction threads of the second type 9.1, 9.4 which continuously form a flotation F on the second side 7 of woven fabric 5 in that they cross a second number of successive cross machine direction threads 10.4-10.6, 10.8-10.2, 10.2-10.4, 10.6-10.8 before they run on the first side 6 of the woven fabric 5 and cross a single cross machine direction thread 10.3, 10.7, 10.1 by forming a bend K. Flotation F in the current example is to be understood to mean that a machine direction thread running on one side of the woven fabric crosses more than two successive cross machine direction threads without interweaving with a cross machine thread on the side opposite to the one side. Bend K in the current example is to be understood to mean that one machine direction thread on one side of the woven fabric continuously crosses only one single cross machine thread, whereby the machine direction thread on the side opposite the one side continuously crosses the cross machine threads which are located before and after this single cross machine thread.

As can be seen in the illustration in FIG. 2 it is advantageous if a bend K is located between successive flotations F, and a flotation F is located between successive bends K.

As illustrated in FIG. 2, the first number of successive cross machine direction threads may also be the same as the second number of successive cross machine direction threads. In the current example the first and the second number is three. However, the first number and/or the second number could also be two, four or five.

In the repeat of woven fabric 5 the machine direction threads 9.1-9.4 are arranged preferably in the following sequence:

- a first machine direction thread of the second type 9.1 which is followed by
- a first machine direction thread of the first type 9.2 which is followed by
- a second machine direction thread of the first type 9.3, which again is followed by
- a second machine direction thread of the second type 9.4.

Within the repeat of the woven fabric

- the first machine direction thread of the second type 9.1 advantageously forms flotations F and bends K with the cross machine direction threads with which also the first machine direction thread of the first type 9.2 forms flotations F and bends K, also
- the first machine direction thread of the first type 9.2 and the second machine direction thread of the first type 9.3 forms bends K with different cross machine direction threads, also
- the second machine direction thread of the first type 9.3 forms flotations F and bends K with the cross machine direction threads with which also the second machine direction thread of the second type 9.4 forms flotations F and bends K.

The first machine direction thread of the first type 9.2 of the repeat and the second machine direction thread of the first type 9.3 may preferably be offset to each other by one to four, especially two cross machine direction threads 10.4, 10.5.

Figure 3:
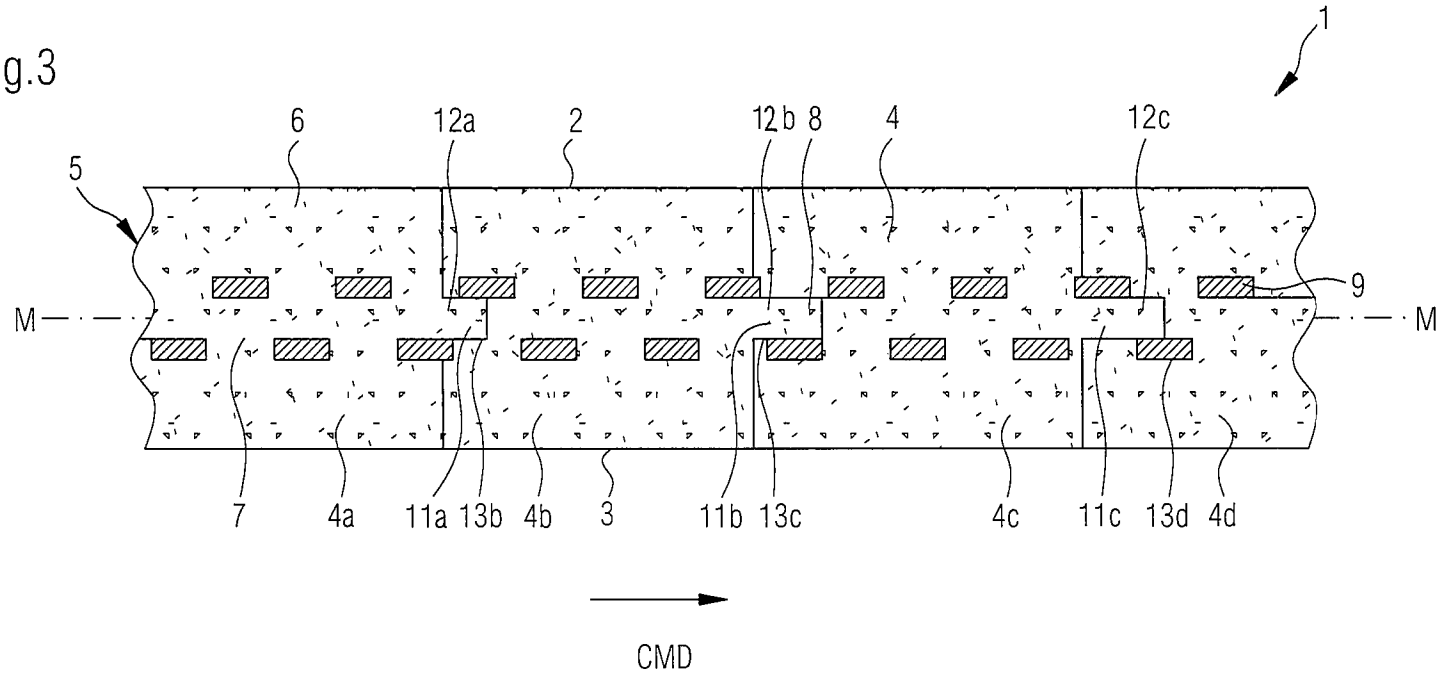
FIG. 3 shows a sectional view of the transport or process belt illustrated in FIG. 1, along cross machine direction of the belt.

FIG. 3 shows a cross section of inventive belt 1 in cross machine direction (CMD). In the illustration of FIG. 3 belt 1 is seen in a section between two adjacent cross machine threads 10. This means, in the illustration in FIG. 3 no cross machine direction thread 10 of the textile fabric in the embodiment of woven fabric 5 is seen. It can however be clearly seen that the polymer coating 4 extends integrally from the first side 6 of textile fabric 5 through openings 8 of textile fabric 5 to the second side 7 of textile fabric 5.

Viewed in cross machine direction CMD polymer coating 4 consists of several coating segments 4*a*-4*d* extending across a partial width of belt 1, whereby adjacent coating segments 4*a*-4*d* overlap in an overlap region 11*a*-11*c*. Coating segments 4*a*-4*d* are connected with each other at least in sections in overlapping region 11*a*-11*c*, whereby bonding is provided preferably through chemical cross linking of the polymer material which provides coating segments 4*a*-4*d*.

As can be seen from FIG. 3 the overlap regions 11*a*-11*c* of adjacent coating segments 4*a*-4*d* are formed in that one coating segment 4*a*-4*d* forms a tab 12*a*-12*c* protruding laterally in cross machine direction and having a lesser thickness than the remaining coating segment 4*a*-4*d* which engages in a conforming recess 13*b*-13*d* of the adjacent coating segment 4*a*-4*d*.

As can be seen, tabs 12*a*-12*c* essentially have a thickness which is consistent with the thickness of the textile fabric. This may be achieved for example by the special process control as described in FIGS. 6*a* and 6*b*. The length of tabs 12*a*-12*c* in CMD can be influenced for example during the production process by the viscosity of the polymer material.

Viewed in cross machine direction at least some of the coating segments—for example in the illustration in FIG. 3 coating segments 4*b* and 4*c* include a tab 12*b*, 12*c* on the one end side and a recess 13*b*, 13*c* on the other end side respectively. (Note: as a rule all coating segments comprise always one tab and one recess with the exception of the coating segments which determine a longitudinal edge of the belt).

For example, coating segment 4*a* viewed in cross machine direction forms tab 12*a* on the one end side which, in order to form the overlap region 11*a* engages in the conforming recess 13*b* of the adjacent coating segment 4*b*.

In addition each coating segment 4*a*-4*d* has an upper and a lower outside surface whereby the upper and/or lower outside surfaces of adjacent coating segments smoothly adjoin.

Figure 4:
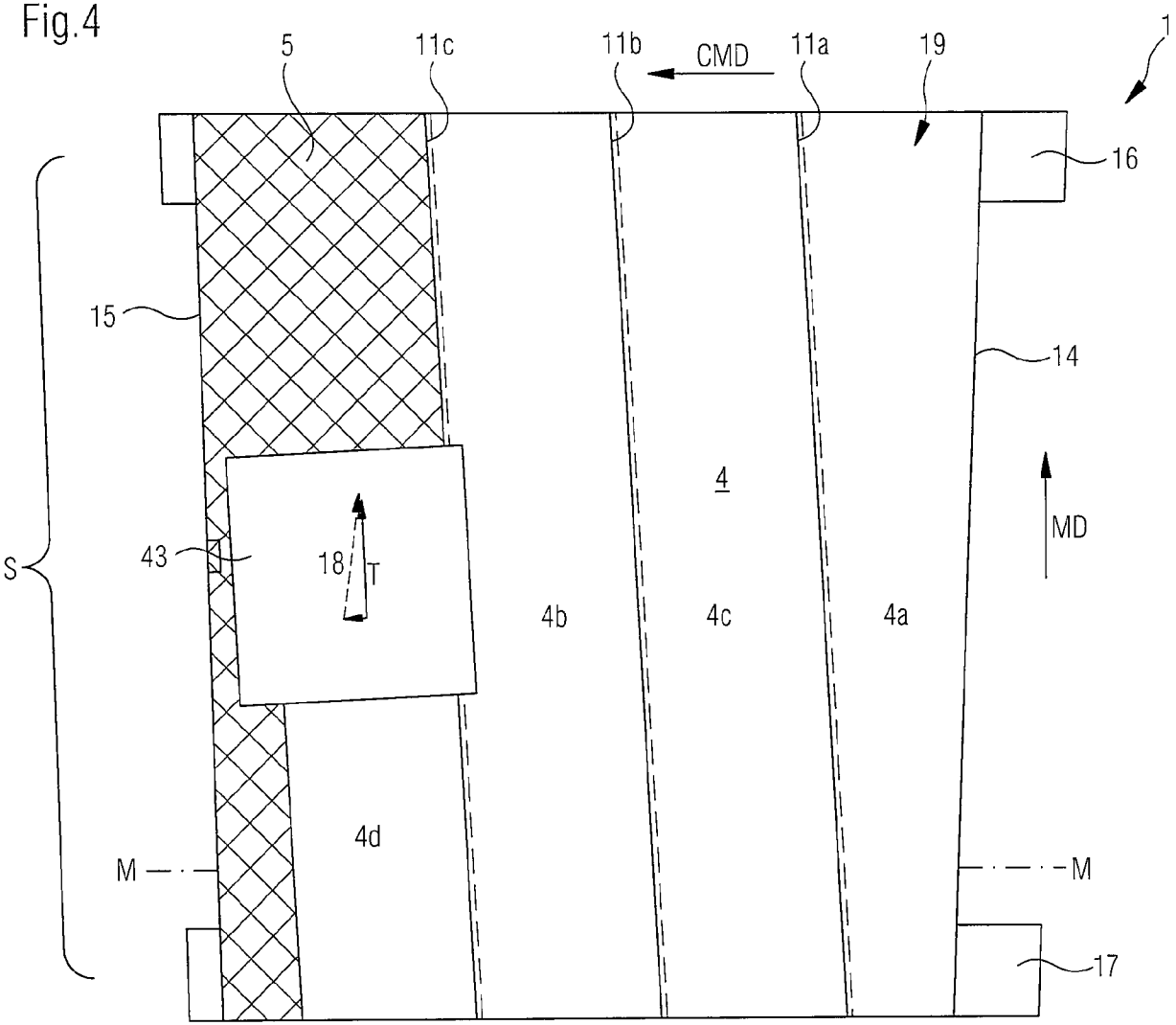
FIG. 4 shows a top view of a device to implement the inventive method for the manufacture of a belt as illustrated in FIG. 1.
Figure 5:
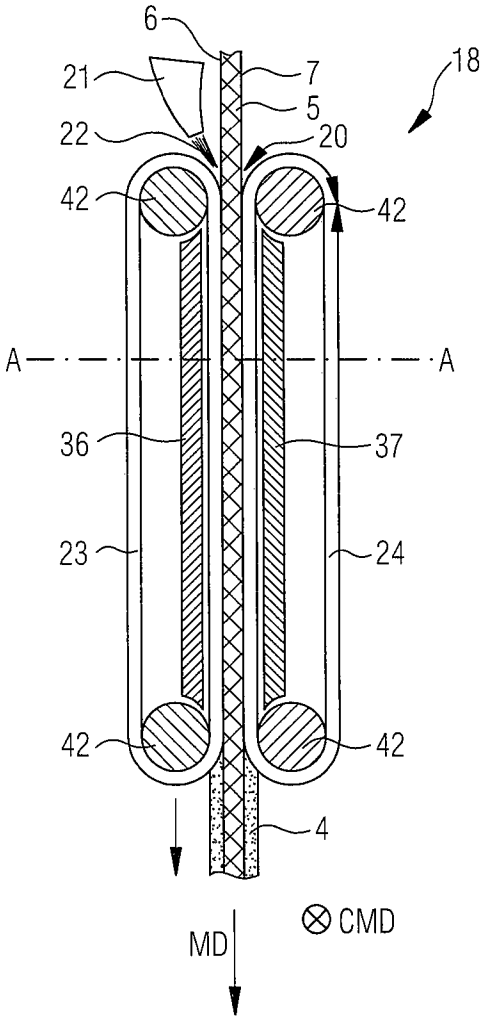
FIG. 5 shows a side view of the device shown in FIG. 4.

FIGS. 4 and 5 show a machine by which an inventive transport or process belt can be produced. FIG. 4 shows the machine and a partially coated textile fabric 5 in a top view. A preferably permeable textile fabric 5 in the form of a continuous belt is stretched over an open distance S between two parallel rolls 16, 17. Textile fabric 5 has a first and a second longitudinal edge 14, 15 extending respectively in the designated machine direction MD of belt 1.

In order to coat textile fabric 5 with polymer material in a viscous state a coating apparatus 18 is used by means of which only a partial width of textile fabric 5 can simultaneously be coated. During the coating process continuous textile fabric 5 is moved in the designated machine direction MD of belt 1 and coating apparatus 18 for the viscous polymer material is moved in the designated cross machine direction CMD of belt 1 relative to each other so that after a single movement of coating apparatus 18 from first longitudinal edge 14 to second longitudinal edge 15 of textile fabric 5 the polymer material is applied in a helix-type path 19 onto textile fabric 5, and textile fabric 5 is completely covered with polymer coating 4.

Figure 6A:
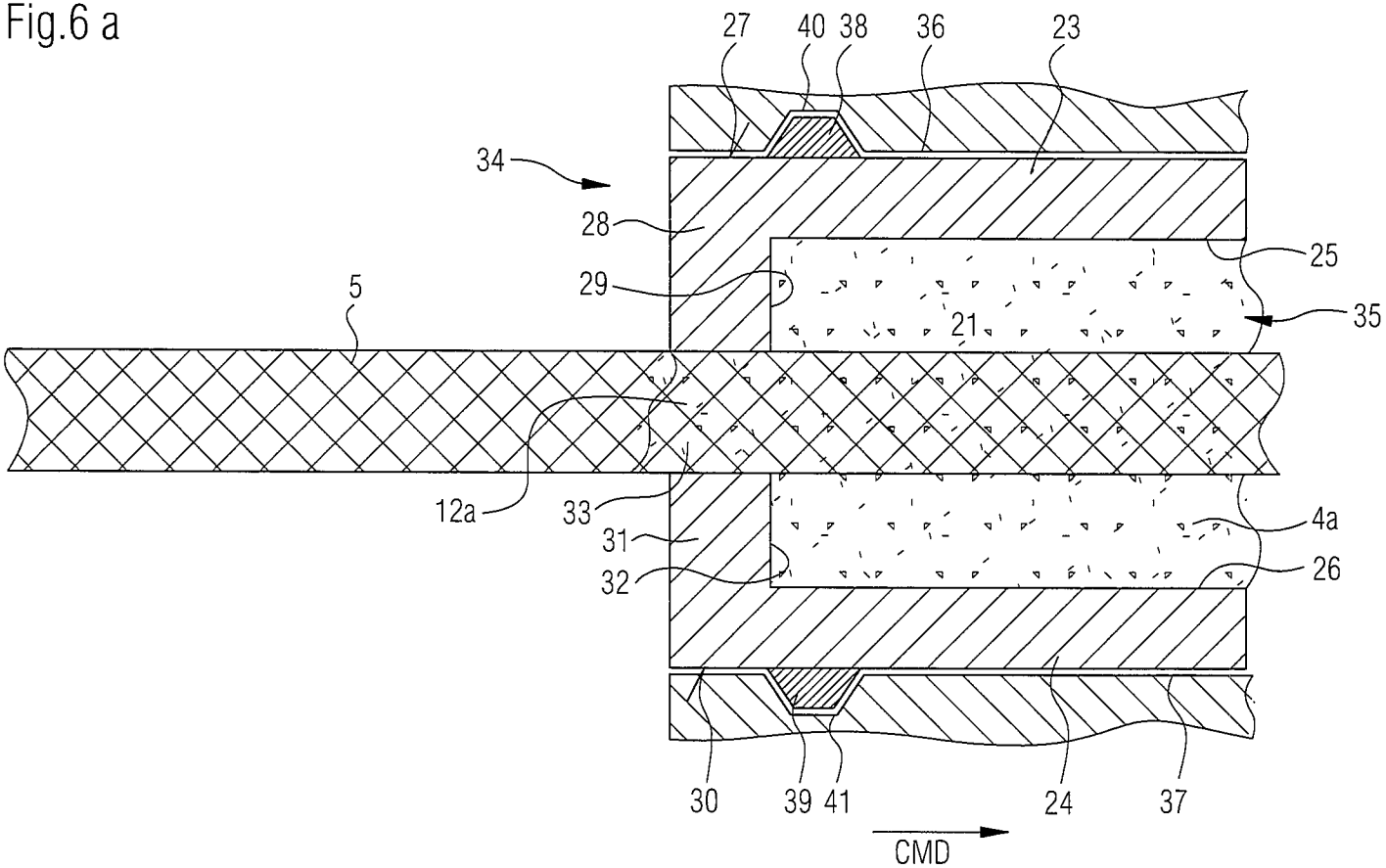
FIGS. 6*a* and 6*b* shows the device from FIGS. 4, 5 in the area of a forming belt at various steps in the manufacture of the belt illustrated in FIG. 1.
Figure 6B:
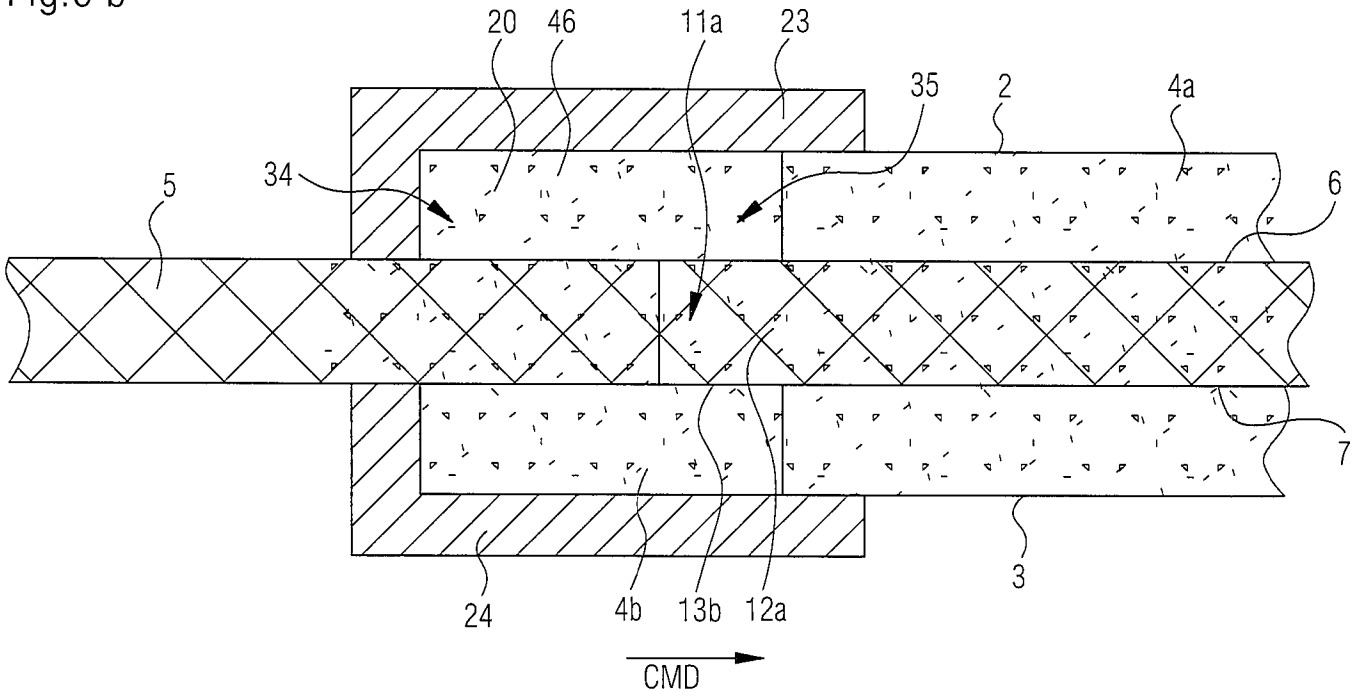
Figure 7:
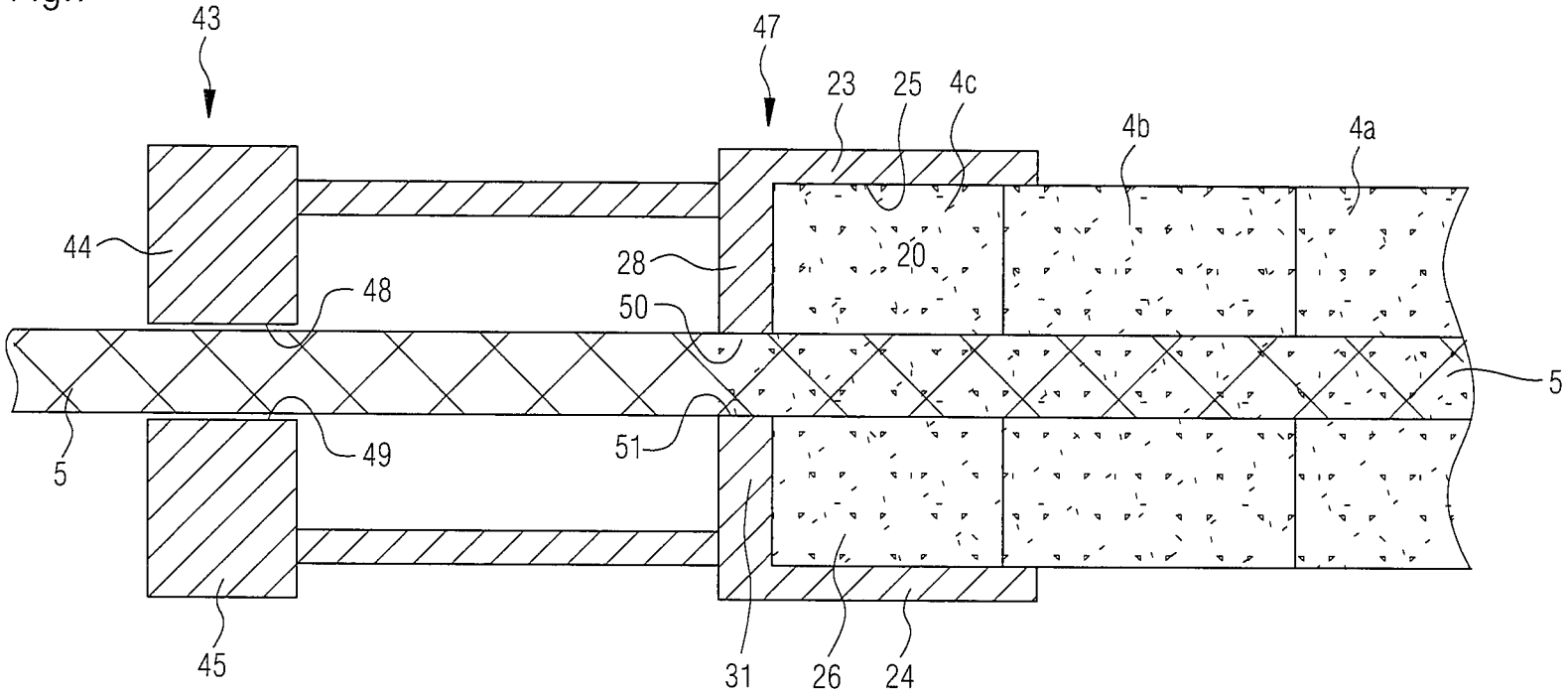
FIG. 7 shows a top view of the device to implement the inventive method to manufacture a belt illustrated in FIG. 1.

Transport direction T of textile fabric 5 through forming channel 20 described in FIGS. 5-7 is consistent with the superimposed position of the movement of coating apparatus 18 with the movement of textile fabric 5.

In addition the coating apparatus includes a holding device 43 by means of which textile fabric 5 is held in position during coating with the viscous polymer material 22 so that no waves or wrinkles occur.

During application of the helix-type path, the adjacent path segments form coating segments 4*a*-4*d* which are known from FIG. 3, whereby adjacent coating segments 4*a*-4*d* overlap respectively in an overlap region 11*a*-11*c*. The solid line in FIG. 4 represents the contact edge between adjacent coating segments 4*a*-4*d* on the paper side of coating 4. The respective overlap region 11*a*-11*c* extends then always from the solid line to the broken line nearest to it.

It would also be conceivable not to apply the polymer coating in form of an uninterrupted helix type path of viscous polymer material onto the textile fabric, but instead apply several self-contained polymer paths which are located adjacent to each other in cross machine direction.

FIG. 5 shows a side view of the machine for the production of inventive belt 1.

Coating apparatus 18 is shown. Coating apparatus 18 comprises a forming channel 20 through which textile fabric 5 which at this stage is uncoated at least across a partial width is fed from above and which leaves forming channel 20 in a downward direction, and coated across a partial width. Coating apparatus 18 further comprises means 21 to feed viscous polymer material 21 into forming channel 20.

As already explained the permeable textile fabric has a first side 6 facing the provided paper side and a second side 7 facing the provided machine side.

Viscous polymer material 22 may be applied from one of the two sides 6, 7 onto the permeable textile fabric 5. In the current example viscous polymer material 22 is applied from the first side 6 of the fabric which faces the paper side 2 of belt 1. It is however also conceivable to apply viscous polymer material 22 from the second side 7 of the textile fabric which faces the provided machine side 3 of belt 1.

Due to the fact that polymer material 22 is applied from one of the two sides 6, 7 in a viscous state onto permeable textile fabric 5 so that it flows from the first side 6 of textile fabric 5 through openings 8 of textile fabric 5 to the second side 7 of textile fabric 5, an integral coating 4 is created which extends from the first side 6 to the second side 7 of textile fabric 5 and which, in contrast to a polymer coating which was applied from two sides onto the textile fabric, has practically no tendency to delaminate.

Influencing factors to cause viscous polymer material 22 to flow from first side 6 to second side 7 of the textile fabric may for example be the permeability and the time required to solidify the viscous polymer material. The time in which polymer material 22 is in the viscous state, and the permeability of textile fabric 5 can be coordinated so that the viscous polymer material can flow from first side 6 of textile fabric 5 through openings 8 of textile fabric 5 to its second side 7.

Polymer material 22 may for example have a viscosity in the range of 250 cps to 1000 cps when reaching the forming channel which enables the viscous polymer material to flow from first side 6 of textile fabric 5 through openings 8 of textile fabric 5 to the second side 7.

The polymer material is advantageously solidified after approx. 10 s to 150 s, especially after approx. 10 s to approx. 50 s from the viscous state to a green state.

In its viscous state polymer material 22 comprises a hardener component and a pre-polymer component. The time for solidification of the viscous polymer material and thereby the viscosity is herewith influenced by the initial weight ratio between hardener and pre-polymer, whereby the initial weight ratio is the weight ratio between hardener and pre-polymer at the time of intermixing. The initial weight ratio includes preferably more hardener than polymer. The polymer material includes especially a duroplastic. Advantageously the polymer is a duroplastic.

The initial weight ratio includes for example between 55% and 80% hardener and between 45% and 20% pre-polymer.

Tests conducted by the applicant have shown that the textile fabric advantageously has a permeability of at least 300 cfm, preferably of at least 550 cfm and a maximum of 1200 cfm.

FIGS. 6*a* and 6*b* illustrate coating apparatus 18 in the area of gap-shaped forming channel 20 along section A-A. Forming channel 20 progresses vertically. Air entrapments in the polymer material during coating can thereby be avoided.

Forming channel 20 is limited on one side and in its thickness by two forming belts 23 and 24.

As already explained, during coating of the permeable textile fabric with viscous polymer material 22, the textile fabric 5 is guided through gap-shaped forming channel 20. Forming channel 20 has a front limiting area 25 and a rear limiting area 26 which respectively extend in forming channel 20 parallel to textile fabric 5 and between which textile fabric 5 is guided. First forming belt 23 provides the front limiting surface 25 and moves in the same direction as textile fabric 5, and essentially at the same speed, while viscous polymer material 22 is fed into forming channel 20 and is carried along by textile fabric 5 and first forming belt 23. At the end of forming channel 20 the first forming belt 23 is separated from the polymer material. As can be seen in FIG. 6, first forming belt 23 has an elevation 28 (in the illustration in FIG. 6 in the area of its left longitudinal edge 27) on its side facing textile fabric 5 and progressing parallel to longitudinal edge 27 of forming belt 23 and which provides a lateral limiting area 29 of forming channel 20.

Second forming belt 24 represents the other of the two limiting areas—in the current example the rear limiting area 26—of forming channel 20, whereby second forming belt 24 in the area of one of its longitudinal edges 30 on the side facing textile fabric 5 has an elevation 31 progressing parallel to longitudinal edge 30 of second forming belt 24 and providing a lateral limiting area 32 to forming channel 20.

Second forming belt 24 also moves in the same direction as textile fabric 5 and essentially at the same speed while viscous polymer material 22 is fed into forming channel 20 and is carried along by textile fabric 5 and second forming belt 24. At the end of forming channel 20 the second forming belt 24 is separated from the polymer material 22.

As can be seen in the illustration in FIG. 6*a*, elevation 28 of first forming belt 23 and elevation 31 of second forming belt 24 laterally limits forming channel 20 on the same side 34. In addition, a segment 33 of textile fabric 5 is run between the two elevations 28, 31.

In the current example textile fabric 5 is run in the area of the forming channel squeezed between elevation 28 of first forming belt 23 and elevation 31 of second forming belt 24. Viewed in width direction of forming channel 20 (this is consistent with cross machine direction CMD) elevations 28, 31 of the two forming belts 23, 24 are located at the same height for this purpose.

In other words, elevation 28 of first forming belt 23 and elevation 31 of second forming belt 24, viewed in width direction (CMD) of forming channel 20, are located relative to each other so that the lateral limiting area 29 of first forming belt 23 is arranged as an extension to lateral limiting area 32 of second forming belt 24.

Since the two elevations 28, 31 have the same height, textile fabric 5 is run centered between front limiting area 25 and rear limiting area 26. If the two elevations were to have a different height, textile fabric 5 would be run off-center between front limiting area 25 and rear limiting area 26.

In addition, forming channel 20 has no lateral limiting areas on the other side 35, located opposite the one side 34.

In addition, textile fabric 5 is wider than the two forming belts 23, 24 viewed in width direction CMD of forming channel 20.

By means of the design and layout of the two forming belts 23, 24 described above, a coated area with a defined thickness is formed in the area between front limiting area 25 and rear limiting area 26 of forming channel 20 during coating of textile fabric 5 with viscous polymer material 22; and in the area between the two elevations 28 and 31 of the first 23 and the second forming belt 24 facing each other a tab 12 with a lesser thickness is formed onto the coated area.

On its side facing away from forming channel 20, first forming belt 23 and/or second forming belt 24 may be supported on an opposite surface 36, 37 in a way that the two forming belts 23, 24 are run at a defined distance from each other in the area of forming channel 20 (see FIG. 5).

Each of forming belts 23, 24 is continuous and is guided around two guide rolls 42 whereby the respective opposite surface 36, 37 in the area of forming channel 20 is located between the two guide rolls 42.

In addition, on the side facing away from forming channel 20, first forming belt 23 and/or second forming belt 24 can have an elevation/recess 38, 39 progressing parallel to longitudinal edge 27, 30 of forming belt 23, 24 with which forming belt 23, 24 is guided along a corresponding recess/elevation 40, 41 in the opposite surface 36, 37 (see FIG. 6*a*).

The direction of travel of both forming belts 23, 24 preferably encompasses an angle of 0.01° to 15°, in particular between 0.2° and 2°, with the longitudinal or machine direction MD of textile fabric 5. Both forming belts 23, 24 move in their direction of travel at a speed in the range of approx. 0.25 m/min. to 1.5 m/min.

FIG. 6*b* illustrates the subsequent steps in the manufacture of transport or process belt 1.

After the permeable textile fabric has been coated on a partial width with viscous polymer material 22, thus forming the initial coated segment 4*a* (as shown in FIG. 6*a*), permeable textile fabric 5 is coated with the viscous polymer material on an additional partial width which partially overlaps the one partial width, thus forming the subsequent coated segment 4*b* which overlaps the initially formed coated segment 4*a* in one overlap area 11*a* in cross machine direction CMD.

For this purpose forming channel 20 and textile fabric 5 are moved relative to each other in their position in cross machine direction, so that forming channel 20 is located, in segments, in a partial area of the textile fabric which has not yet been provided with a coating segment. Since in the current example the polymer coating is applied in a helix-type path, shifting of the offset of the forming channel relative to the textile fabric occurs continuously. As can be seen from the illustration in FIG. 6*b*, forming channel 20 is limited on the one side 34 by two lateral limiting areas 29, 32 of both forming belts 23, 24, whereas on the other side 35 forming channel 20 is limited laterally by coating segment 4*a* which was produced immediately prior. Here the two forming belts 23, 24 overlap the initially formed coated segment 4*a* so that, on the one hand, they rest on this coated segment 4*a* and, on the other hand provide forming channel 20.

As already explained, the initially formed coated segment 4*a* has a tab 12*a* in the overlap area 11*a*, protruding in cross machine direction CMD and the additional subsequently formed coated segment 4*b* has a corresponding recess 13*b* with which tab 12*a* engages.

Subsequently in the method a bond between the two coated segments 4*a* and 4*b* is caused in overlap area 11*a*.

As already explained in the description of FIGS. 4 and 5 the two adjacent partially wide coated segments 4*a* and 4*b* are formed in that the continuous textile fabric 5 is coated with polymer material 22 in a partial width path 19 which runs around textile fabric 5 in a continuous helix type pattern.

Immediately after application of polymer material 22, a conversion from the viscous state to a solid state of polymer material 22 is caused. Here it is conceivable that the bond of the two coated segments 4*a* and 4*b* in overlap area 11*a* and the conversion of polymer material 22 from the viscous state to a solid state can occur at least partially simultaneously.

The conversion of polymer material 22 from the viscous state to the solid state includes preferably cross-linking of polymer material 22. In other words, a chemical cross-linking takes place. For this purpose the polymer material may in particular have a hardener component and a pre-polymer component which are intermixed immediately prior to the coating process, whereby cross-linking begins immediately after mixing of the two components.

In order to achieve a good and solid bond of coating segments 4*a*, 4*b* in overlap area 11*a* it is especially advantageous if coating of textile fabric 5 with the polymer material when creating the subsequent coating segment 4*b* occurs, as long as the polymer material of the initially formed coated segment 4*a* is not yet completely cross-linked. It is preferable if the subsequent coated segment is produced while the polymer material of the initially formed coated segment 4*a* remains in a green state.

Tests conducted by the applicant have shown that the ratio between hardener and pre-polymer is adjusted so that the duroplastic polymer material 22 solidifies after approx. 10 s to 150 s, especially after approx. 10 s to approx. 50 s, from the viscous state to a green state.

Tests conducted by the applicant have further shown that a permanent bond of the coated segments which partially overlap each other can be achieved especially when an additional coated segment 4*b* is formed within 24 hours after a prior coated segment 4*a* was formed.

In order to make the bond between adjacent coated segments, for example 4*a* and 4*b*, or 4*b* and 4*c*, very durable it can be advantageous to subject the polymer material of the initially formed coated segment in the area of tab 12*b*, 12*c*, 12*d* to a thermal treatment, especially a heat treatment immediately prior to creating the subsequent coated segment.

As can be seen from the illustrations in FIGS. 3 and 6*b* the respective tab 12*a*, 12*b*, 12*c* extends essentially inside textile fabric 5 which, in the current example, can be achieved by the specific embodiment of the two forming belts 23, 24 and their positioning relative to each other.

Tabs 12*a*-12*c* essentially have a thickness which is consistent with the thickness of textile fabric 5. This can be achieved for example by the specific process control, in other words in that textile fabric 5 is run between the two elevations 28, 31 of the two forming belts 23, 24. The length of tabs 12*a*-12*c* can be influenced, for example, through the viscosity of the polymer material during the manufacturing process.

Application of the polymer material is preferably conducted so that the tab of the coated segment which is produced first extends in cross machine direction between 10 mm and 50 mm, especially between 20 mm and 35 mm, into the recess of the subsequently formed coated segment.

The application of the polymer material is in addition conducted preferably so that the respective coated segments 4*a*-4*d* extend in cross machine direction CMD between 100 mm and 500 mm, especially between 150 mm and 300 mm.

As can be seen from the illustration in FIG. 6*b*, polymer coating 4 which is formed by the different coated segments preferably provides machine side 2 and/or paper side 3 of belt 1.

In addition all coated segments 4*a*-4*d* have preferably the same thickness, whereby the upper and/or the lower outside surfaces of adjacent coating segments 4*a*-4*d* smoothly adjoin.

It can also be seen in the illustration in FIG. 6*b* that polymer coating segments 4*a*-4*d* extend at least in some regions from the first side 6 of textile fabric 5 through openings 8 of textile fabric 5 to the second side 7 of textile fabric 5. Each of the coating segments 4*a*-4*d* is integral.

FIG. 7 shows a simplified illustration of the device depicted in FIGS. 4-6 in the area of the two forming belts. It can be said generally that in the method for the manufacture of the transport or process belt by means of coating permeable textile fabric 5 with polymer material 22 in a viscous state, textile fabric 5 is run through the gap-shaped forming channel 20, whereby forming channel 20 has a front limiting area 25 and a rear limiting area 26 which respectively extend parallel to textile fabric 5 and between which textile fabric 5 is guided along a transport direction (Note: in FIG. 7 the transport direction extends essentially vertically to the drawn plane; the transport direction results from superimposing of the movement of textile structure 5 in machine direction and cross-directional movement of coating apparatus 18).

In addition, means are provided by which textile fabric 5 is held in position during coating with the viscous polymer material so that it does not produce any waves or wrinkles. In the current example the means include a first and a second holding device 43, 47 arranged at the height of forming channel 20 and having opposite surfaces 48-51 between which textile fabric 5 is squeezed.

The two holding devices 43, 47 are located outside forming channel 20.

Holding textile fabric 5 in position hereby includes stretching of textile fabric 5 in forming channel 20, in cross direction to the transport direction.

As already explained, front limiting area 25 of forming channel 20 is provided by first forming belt 23; and rear limiting area 26 of forming channel 20 is provided by second forming belt 24 between which textile fabric 5 is guided. Here, the two forming belts 23, 24 run in the same direction and essentially at the same speed as the textile fabric 5.

First holding device 43—viewed in cross direction to the transport direction—is located at a distance from the two forming belts 23, 24, whereby the distance between first holding device 43 and the two forming belts 23, 24 is between 10 cm and 100 cm, preferably between 30 cm and 55 cm.

In the first holding device 43 the two opposite surfaces 48, 49 are provided by a pair of rollers 44, 45 which are rotatable in transport direction of the textile fabric.

Second holding device 47 is provided by the two elevations 28, 31 of forming belts 23, 24 which face toward textile fabric 5 and between which textile fabric 5 is squeezed and guided. In the second holding device 47 an offset of the two opposite surfaces 50, 51 at cross direction to the transport direction is preferably avoided through appropriate means, thereby further avoiding creation of waves or folds in the textile fabric.

Textile fabric 5 is held by the two holding devices 43, 47 in an area which has not yet been coated, whereby textile fabric 5 is coated in the second holding device 47 during the holding process and while a tab is formed.

Textile fabric 5 is held in position during the coating process by the two holding devices 43, 47 so that a centered position of textile fabric 5 in the polymer coating 4 is ensured. In addition, occurrence of wrinkles or waves in textile fabric 5 is avoided during the coating process. Obviously, according to the invention only one of the two holding devices 43, 47 may be provided. However, provision of both holding devices 43, 47 provides an especially effective centering of textile fabric 5, as well as effective avoidance of wrinkles and waves.

In the current example the two opposite surfaces are provided by a pair of rolls 44, 45 which are rotatable in transport direction of textile fabric 5, whereby in the current example each of the two opposite surfaces is rigidly connected with one of the two forming belts 23, 24.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A belt, which is one of a transport belt and a process belt, being for one of a paper machine, a cardboard machine, and a tissue machine for one of producing and treating a web of fibrous material and having a paper side and a machine side, said belt comprising:

a textile fabric which is load-bearing and which includes a first side facing the paper side and a second side facing the machine side, said textile fabric being permeable and having a permeability of at least 300 cubic feet per minute, said textile fabric including a plurality of openings; and a polymer coating extending integrally from said first side of said textile fabric through said plurality of openings in said textile fabric to said second side of said textile fabric, viewed in a cross machine direction said polymer coating including a plurality of coating segments extending respectively across only a partial width of the belt, said plurality of coating segments including respectively adjacent coating segments overlapping respectively in an overlap region and being connected with each other at least in segments of said overlap region, said polymer coating being made from a polymer material, said adjacent coating segments in said overlap region being bonded with each other through chemical cross linking of said polymer material, said adjacent coating segments including a first coating segment and a second coating segment which is adjacent to said first coating segment, said first coating segment including a tab which protrudes laterally in said cross machine direction and has a lesser thickness than a remainder of said first coating segment, said second coating segment including a recess which conforms to said tab, said overlap region of said adjacent coating segments being formed in that said tab of said first coating segment engages said recess of said second coating segment.

2. The belt according to claim 1, wherein said textile fabric has a permeability of at least 550 cubic feet per minute.

3. The belt according to claim 1, wherein said polymer coating is made from a single polymer material, at least from said first side through to said second side of said textile fabric.

4. The belt according to claim 1, wherein said polymer coating extends from the paper side of the belt to the machine side of the belt.

5. The belt according to claim 1, wherein the belt is an impermeable belt due to said polymer coating.

6. The belt according to claim 1, wherein the belt has an overall thickness of 2 millimeters to 6 millimeters.

7. The belt according to claim 1, wherein a ratio of an overall thickness of the belt to a thickness of said textile fabric is in a range of 2:1 to 5:1.

8. The belt according to claim 1, wherein said polymer coating from the paper side of the belt to the machine side of the belt is made from a single polymer material.

9. The belt according to claim 1, further including at least one filler embedded into said polymer coating.

10. The belt according to claim 1, wherein said polymer coating is made from a polymer material which includes polyurethane.

11. The belt according to claim 1, wherein each of said plurality of coating segments has an upper outside surface and a lower outside surface, at least one of each said upper outside surface and each said lower outside surface of said adjacent coating segments adjoining smoothly relative to one another.

12. The belt according to claim 1, wherein said textile fabric has a permeability in the range of approximately 500 cubic feet per minute to approximately 750 cubic feet per minute.

13. The belt according to claim 1, wherein said textile fabric has a permeability in the range of approximately 550 cubic feet per minute to approximately 1200 cubic feet per minute.

14. The belt according to claim 1, wherein said textile fabric is formed one of by itself and in combination with at least one of a woven fabric, a spiral wire, and a yarn array.

15. The belt according to claim 1, wherein said textile fabric includes a plurality of machine direction threads and a plurality of cross machine direction threads, said plurality of cross machine direction threads having a greater flexural strength in a longitudinal direction of said plurality of cross machine direction threads than said plurality of machine direction threads in a longitudinal direction of said plurality of machine direction threads.

16. The belt according to claim 15, wherein said plurality of machine direction threads, in a cross-section of each of said plurality of machine direction threads, have a greater width than height.

17. The belt according to claim 15, wherein said plurality of cross machine direction threads, in a cross-section of each of said cross machine direction threads, have a width which is essentially equal to a height.

18. The belt according to claim 15, wherein said textile fabric is a woven fabric, said plurality of machine direction threads being interwoven with said plurality of cross machine direction threads, wherein, in order to form said woven fabric, said plurality of machine direction threads are more curved in a longitudinal progression of said plurality of machine direction threads than said plurality of cross machine direction threads in a longitudinal progression of said plurality of cross machine direction threads.

19. The belt according to claim 18, wherein said plurality of cross machine direction threads are essentially not curved in said longitudinal progression of said plurality of cross machine direction threads.

20. The belt according to claim 18, wherein said woven fabric includes a repeat weaving pattern, said plurality of machine direction threads including a plurality of machine direction threads of a first type and a plurality of machine direction threads of a second type, said repeat weaving pattern including said plurality of machine direction threads of said first type which, on said first side of said textile fabric, continuously cross a first number of successive ones of said plurality of cross machine threads, thereby creating a flotation before said plurality of machine direction threads of said first type continuously cross a single one of said plurality of cross machine direction threads on said second side of said textile fabric while creating a bend, said repeat weaving pattern including said plurality of machine direction threads of said second type which, on said second side of said textile fabric, continuously cross a second number of successive ones of said plurality of cross machine direction threads, thereby creating another said flotation, before said plurality of machine direction threads of said second type continuously cross a single one of said plurality of cross machine direction threads on said first side of said textile fabric, thereby creating another said bend.

21. The belt according to claim 20, wherein each said bend is arranged between successive ones of said flotation and each said flotation is arranged between successive ones of said bend.

22. The belt according to claim 21, wherein said first number of successive ones of said plurality of cross machine threads is equal to said second number of successive ones of said plurality of cross machine direction threads.

23. The belt according to claim 21, wherein said repeat weaving pattern includes a first said machine direction thread of said second type, a first said machine direction thread of said first type, a second said machine direction thread of said first type, and a second said machine direction thread of said second type.

24. The belt according to claim 23, wherein, within said repeat weaving pattern, said first machine direction thread of said second type forms a plurality of said flotation and a plurality of said bend with said plurality of cross machine direction threads with which also said first machine direction thread of said first type forms said plurality of flotations and said plurality of bends, said first machine direction thread of said first type and said second machine direction thread of said first type forming said plurality of bends with different ones of said plurality of cross machine direction threads, said second machine direction thread of said first type forming said plurality of flotations and said plurality of bends with said plurality of cross machine direction threads with which also said second machine direction thread of said second type forms said plurality of flotations and said plurality of bends.

25. The belt according to claim 24, wherein said first machine direction thread of said first type and said second machine direction thread of said first type are offset to each other by one to four of said plurality of cross machine direction threads.

26. The belt according to claim 24, wherein said first machine direction thread of said first type and said second machine direction thread of said first type are offset to each other by two of said plurality of cross machine direction threads.

27. The belt according to claim 24, wherein at least one of said first number of successive ones of said plurality of cross machine threads and said second number of successive ones of said plurality of cross machine threads is one of two, three, four, and five.

* * * * *